US005254981A

United States Patent [19]

Disanto et al.

[11] Patent Number: 5,254,981

[45] Date of Patent: Oct. 19, 1993

[54] ELECTROPHORETIC DISPLAY EMPLOYING GRAY SCALE CAPABILITY UTILIZING AREA MODULATION

[75] Inventors: Frank J. Disanto, North Ills; Denis A. Krusos, Lloyd Harbor; Christopher Laspina, Syosset, all of N.Y.

[73] Assignee: Copytele, Inc., Huntington Station, N.Y.

[21] Appl. No.: 975,119

[22] Filed: Nov. 12, 1992

Related U.S. Application Data

[63] Continuation of Ser. No. 402,774, Sep. 15, 1989, abandoned.

[51] Int. Cl.[5] ..... G09G 3/34

[52] U.S. Cl. ..... 345/107; 345/149

[58] Field of Search ..... 340/787, 703, 767, 784, 340/793; 358/230, 236, 429; 382/50, 54

[56] References Cited

U.S. PATENT DOCUMENTS

| | | | |
|---|---|---|---|
| 4,531,160 | 7/1985 | Ehn | 358/230 |
| 4,688,031 | 8/1987 | Haggerty | 340/703 |
| 4,706,077 | 11/1987 | Roberts et al. | 340/793 |
| 4,754,488 | 6/1988 | Lyke | 340/703 |
| 4,786,975 | 11/1988 | Postl | 358/249 |
| 4,827,255 | 5/1989 | Ishii | 340/793 |
| 4,833,464 | 5/1989 | Di Santo et al. | 340/793 |
| 4,945,351 | 7/1990 | Naiman | 340/793 |

FOREIGN PATENT DOCUMENTS

| | | | |
|---|---|---|---|
| 63-287828 | 3/1989 | Japan | 340/793 |

OTHER PUBLICATIONS

D. R. Thompson; "Skew Coding Technique for Digital Halftones"; IBM Technical Disclosure Bulletin; vol. 20, No. 1; Jun./1977; pp. 254-256.

*Primary Examiner*—Ulysses Weldon
*Assistant Examiner*—M. Fatahi-yar
*Attorney, Agent, or Firm*—Arthur L. Plevy

[57] ABSTRACT

A apparatus provides grey scale capability for an electrophoretic information display. The electrophoretic information display is an XY addressable display with each XY coordinate indicative of a given column and row and defining a pixel. There are described various circuit configurations coupled to the display for impressing upon the display a predetermined digital pattern to cause certain pixels in the display to be energized with respect to other pixels in the display where the combination due to the digital pattern causes a desired grey scale level to appear on a character or on the background of the display.

14 Claims, 8 Drawing Sheets

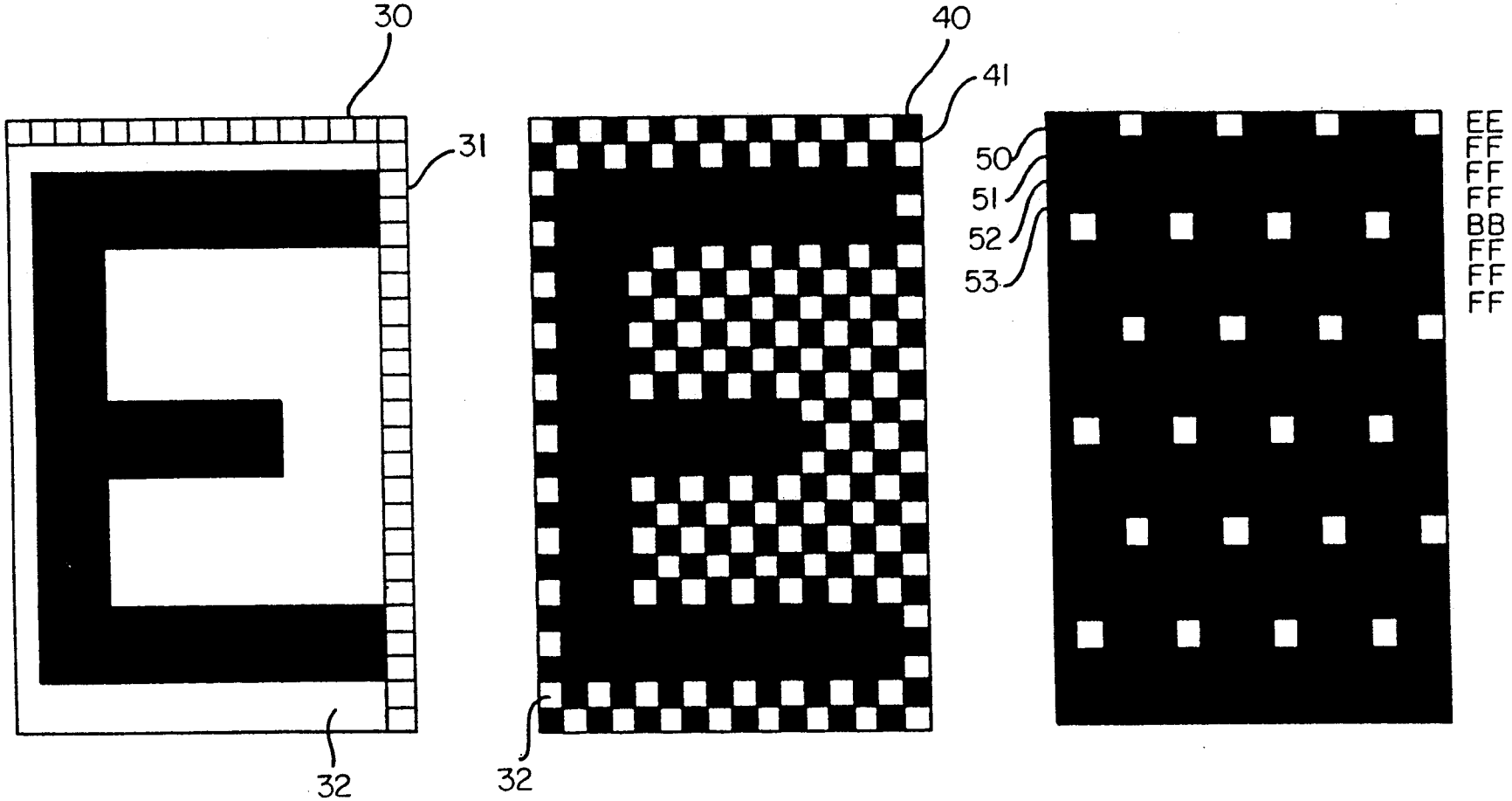
EEEE

ELECTROPHORETIC DISPLAY EMPLOYING GRAY SCALE CAPABILITY UTILIZING AREA MODULATION

This is a continuation of application Ser. No. 07/402,774 filed Sep. 15, 1989, now abandoned.

BACKGROUND OF THE INVENTION

This invention relates to electrophoretic information displays (EPID) in general and more particularly to apparatus which operates in conjunction with an EPID display enabling such a display to operate with grey scale capability.

The prior art is replete with a number of various patents and articles concerning electrophoretic displays. Such electrophoretic displays have been widely described and disclosed in the prior art and essentially the assignee herein, Copytele Inc. of Huntington Station, N.Y. has developed an electrophoretic display which has an image area of approximately $11 \times 8\frac{1}{2}$ inches and is designed to be used either as a separate display or to be combined with other displays. The company has the ability to combine as many as four such displays to create larger area displays. The information on such displays can be changed either locally or remotely and can be viewed at an angle of nearly 180 degrees. Such displays have extremely high resolution and can accommodate over 160,000 pixels within an image area of approximately 2.8 inches diagonally. In regard to such displays, reference is made to U.S. Pat. No. 4,655,897 issued on Apr. 7, 1987 entitled ELECTROPHORETIC DISPLAY PANELS AND ASSOCIATED METHODS to Frank J. DiSanto and Denis A. Krusos and assigned to Copytele Inc., the assignee herein. In that patent, there is described an electrophoretic display panel which includes a planar transparent member having disposed on the surface a plurality of vertical conductive lines to form a grid of wires in the Y direction. On top of the grid of vertical lines, there is disposed a plurality of horizontal lines which are positioned above the vertical lines and insulated therefrom by a thin insulating layer at each of the intersection points. Spaced above the horizontal and vertical line pattern is a conductive plate. The space between the conductive plate and the X and Y line pattern is filled with an electrophoretic dispersion containing chargeable pigment particles. When a voltage is impressed on the X and Y lines, pigment particles which are located in the wells or depressions between the X and Y pattern are caused to migrate towards the conductive plate and deposited on the plate in accordance with the voltage applied to the X and Y conductors. There is described in that patent an electrophoretic dispersion suitable for operation with the display as well as techniques for fabricating the display. Hence, in this manner the displays can be fabricated to contain large effective display areas while being relatively thin. These displays are capable of high resolution and relatively low power consumption. As indicated, the above noted patent and others include information concerning the fabrication, operation and resolution of such displays. As explained in U.S. Pat. No. 4,833,464 issued on May 23, 1989 and entitled ELECTROPHORETIC INFORMATION DISPLAY (EPID) APPARATUS EMPLOYING GREY SCALE CAPABILITY to F. J. DiSanto, et al., it is a problem with such displays to provide grey scale capability. Grey scale capability is a well known term of the art and has been utilized for example in regard to the description of television receivers and various other types of data presentation, such as facsimile and so on. In the case of television receivers, the response of the receiver can be visually determined by means of typical test patterns such as those test patterns that were previously transmitted and displayed when, for example, a television station goes off the air. Various television stations frequently transmit such a pattern for the convenience of service technicians and so on. The pattern apart from showing correct linearity, for example, also shows correct reproduction of the background shading which can indicate proper frequency response. The correct reproduction of the five color shades in the center target area of the test pattern indicates proper mid frequency responses. As one can ascertain such test patterns are associated with grey scale capability, namely with the display of various grey levels as located between black and white. Such grey scale capability is a desirable feature in conjunction with any type of display. An electrophoretic display either presents a black or white type of representation of an image which is conveniently referred to as dark or light. Basically the color of the image is a function of the color of the pigment particles and the color of the suspension that they are suspended in. The display may be black and white, yellow and black and so on. There are a wide variety of many potential color combinations which can be employed in regard to such displays. The above noted U.S. Pat. No. 4,833,464 describes apparatus and techniques for grey scale operation for an electrophoretic display panel. The apparatus includes circuitry which operates with a timing generator which produces a plurality of different time duration output wave forms which are applied to the X and Y drive as associated with the display. In this manner, by applying a set of voltages for a given duration time interval, a display is provided which results in the incomplete removal of pigment from associated selected pixels. Hence, those pixels appear darker than surrounding pixels but not as dark as the pure dye solution as associated with the display. Thus, the amount of pigment removed and hence the darkness of each pixel is a function of the time duration during which the appropriate voltage is applied to the rows and columns of the display. The timing generator can cause different pixels as displayed to have different darknesses or grey scale values by varying the time during which the voltage is applied to the display. As will be further explained, grey scale operation at different shades of grey can also be provided on an electrophoretic display by means of area modulation. Area modulation can be used to shade either the foreground, the background or both the foreground and the background. Such electrophoretic displays, as other displays, portray information by writing in two different colors or shades of the same color. These of course can be referred to as black or white, although many other color combinations are available as indicated above. Thus in an electrophoretic display, the normal background color is the color of the pigment used in the display and the written characters and graphics are generated by removing pigment from the appropriate areas. In the reverse or inverse video mode the pigment is removed from the background while pigment is retained in the areas of the characters or graphics. This is the same difference, for example, between a negative and positive in photography. As will be explained, by performing area modulation by writing a pattern of either black or white pixels in either the background, foreground or both, permits generation of shades of grey. It is also understood that area modulation can be used with any relatively high resolution display to in fact provide a grey scale capability for the display.

It is therefore an object of the present invention to provide an electrophoretic display having grey scale capability.

It is a further object of the present invention to provide an electrophoretic display apparatus which has grey scale capability and which operates to modulate the area about each character or the area within each character on a display.

SUMMARY OF THE INVENTION

Apparatus for providing grey scale capability for an electrophoretic information display (EPID), wherein said electrophoretic display is an X-Y addressable display with each X-Y coordinate indicative of a given column and row intersection, with each X-Y coordinate defining a pixel, which pixel when energized provides a different intensity display as compared to a non-energized pixel comprising of means coupled to said display for impressing upon said display a predetermined digital pattern to cause predetermined pixels in said display to be energized with respect to other pixels in said display in accordance with a desired grey scale level.

BRIEF DESCRIPTION OF THE FIGURES

FIG. 3 is a graph depicting a character block displayed on a conventional black and white display.

FIG. 4 depicts a character displayed with a predetermined area modulated background pattern.

FIG. 5 shows still another area modulated pattern.

DETAILED DESCRIPTION OF THE FIGURES

Figure 1:
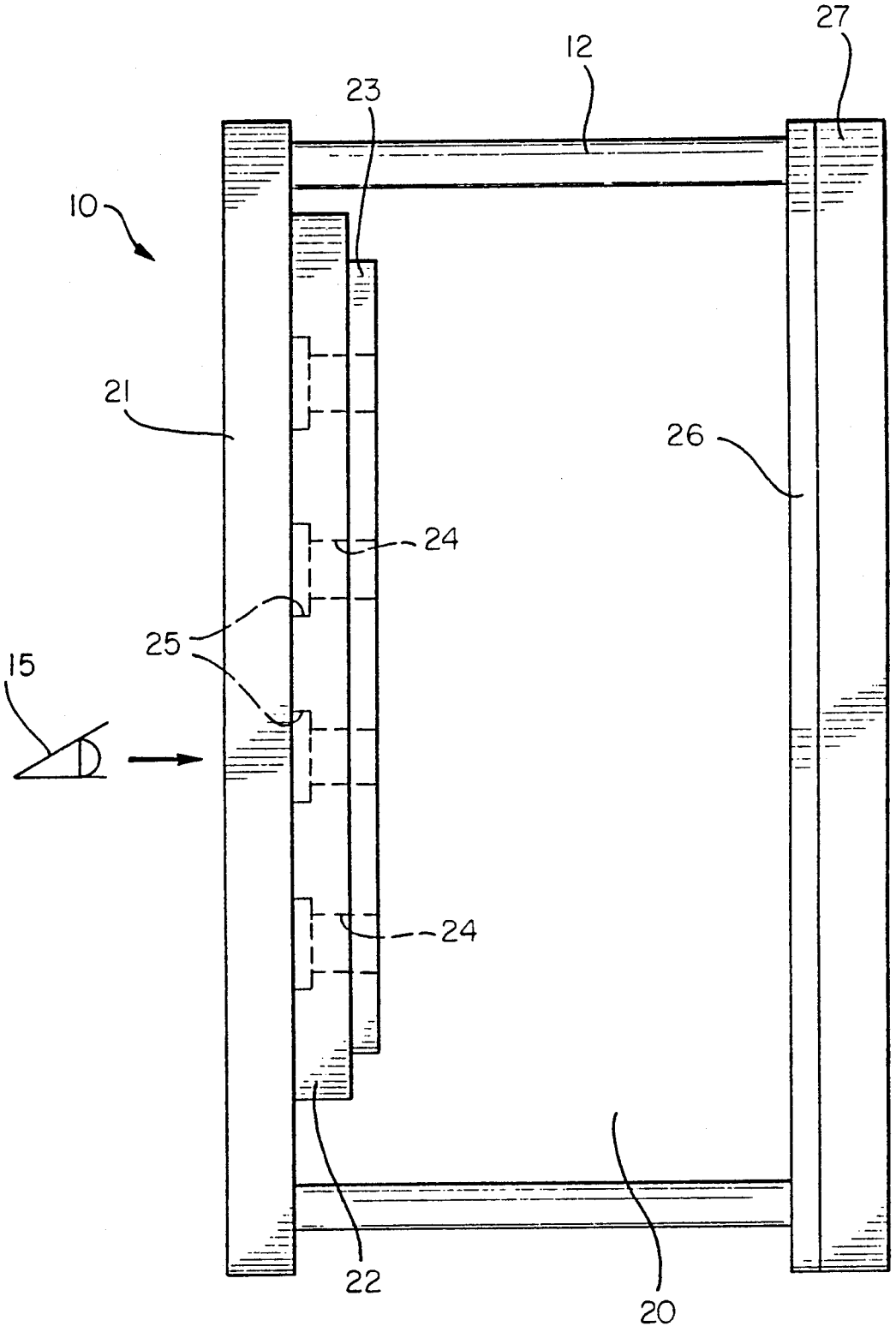
FIG. 1 is a side plan view of an electrophoretic display (EPID) employed in this invention.

Referring to FIG. 1, there is shown a side view of a typical electrophoretic display 10. The display 10 of FIG. 1 is filled with an electrophoretic solution 20 which includes light colored pigment particles suspended in a dark dye solution. For examples of such solutions and techniques reference is made to the above cited U.S. Pat. No. 4,655,897. It is also understood that the display can consist of a dark pigment suspended in a light solution and so on. As seen from FIG. 1, the display contains a front glass sheet or viewing surface 21. The eye of the viewer 15 is shown viewing the front of the display via the glass sheet 21. Superimposed upon the glass sheet 21 by suitable etching techniques are columns 23 and rows 25. The rows are made from an extremely thin layer of indium-tin-oxide (ITO) while the columns are made from thin layers of aluminum or other suitable metals. These patterns, as indicated, are provided in extremely thin layers and constitute an XY matrix. The layers of ITO as can be seen by reference to the above noted patent are relatively thin being approximately 300 Angstroms thick. The grid or columns and the rows or cathodes (XY) are spaced from one another and insulated from one another by means of an insulating layer 22. While the grids and cathodes have been specified in terms of rows and columns, it is understood that the terms can be interchanged as desired. Each of the grid and cathode intersections are associated with a pigment well 24. These wells contain electrophoretic solution which is in the cavity 20. The columns and rows are separated from a back electrode 26 which is also fabricated on a sheet of glass 27 and constitutes a thin layer of ITO. The spacers such as 12 and 23 can be implemented in many different ways and essentially serve to mechanically separate the display or panel 10. In operation of the display, the pigment particles contained in the electrophoretic solution 20 are brought forward towards the viewing surface in order to fill the wells formed between the rows and columns. Once a well such as 24 is filled, the voltage on the rows and columns and rear cover is then set, such that the wells remain filled, but pigment spaced between the rear cover and the columns are swept onto the rear cover plate 26. At viewing side 21 one sees the color of the pigment in the wells. By selectively applying voltages to the rows and columns, the pigment in the individual wells 24 (at the intersection of the rows and columns selected) is forced out of the wells exposing the dye solution and making that intersection (pixel) dark. The removal of the pigment from the wells is not instantaneous but requires a period of time which depends upon the dimension of the cell or display, the fluid components, and the various supply voltages. The above noted patent U.S. Pat. No. 4,833,464 discusses the control of the voltages and the duration of the same to control grey scale operation. The techniques for performing area modulation in conjunction with an electrophoretic display will be described in detail herein.

Figure 2:
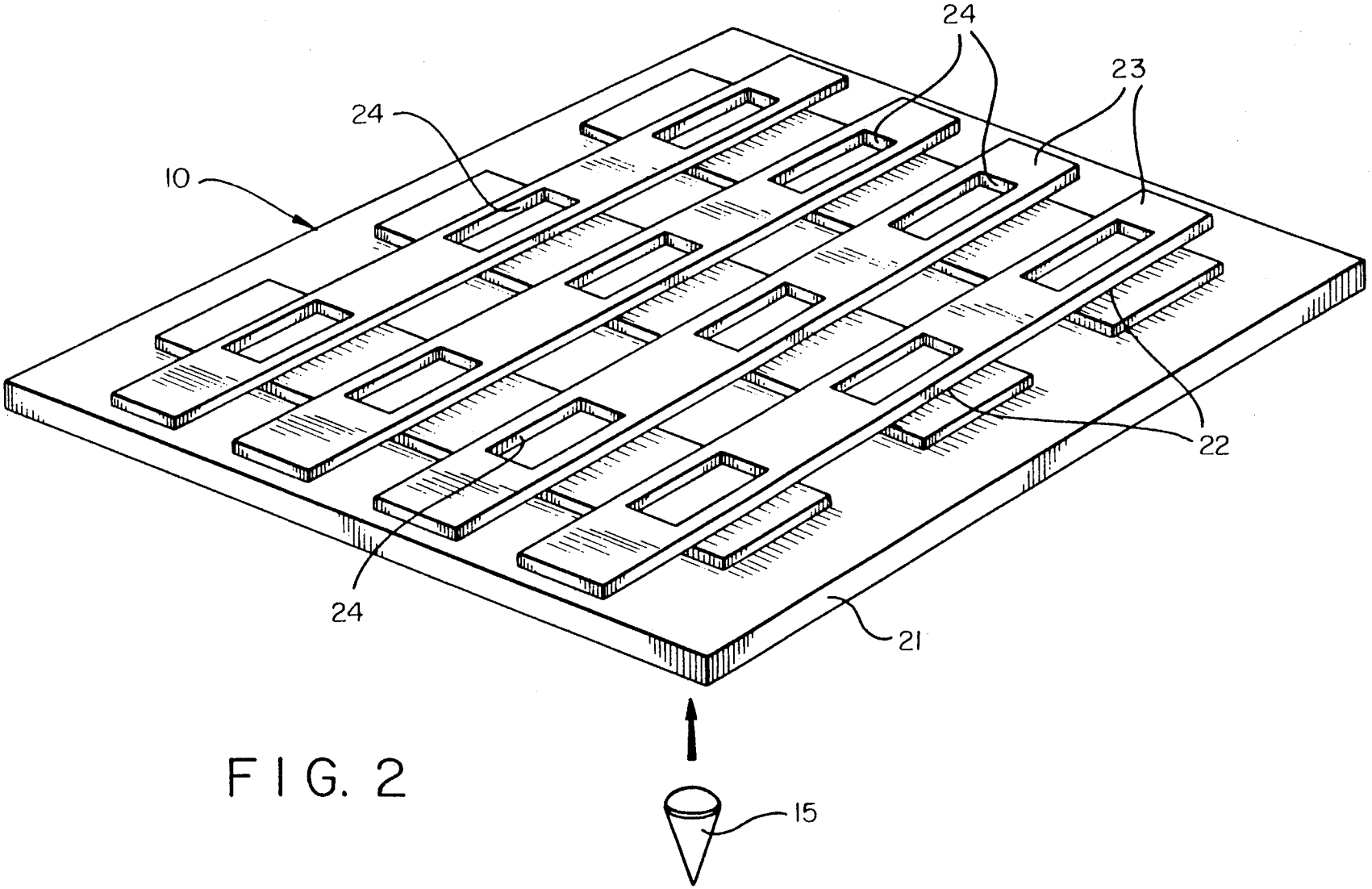
FIG. 2 is a perspective plan view of an electrophoretic display panel showing a given number of grid and cathode lines.

Referring to FIG. 2, there is shown a plan view of an enlarged representation of an electrophoretic display cell or panel according to FIG. 1. As seen in FIG. 2, each well is accommodated between an intersection of a column metal layer 23, which is insulatively separated from a row layer of ITO 25. The well 24 forms a pixel area which is indicative of an XY intersection of the ITO display. Thus, as one will understand, the object of the present invention is to provide grey scale capability and this grey scale capability is performed in a high resolution electrophoretic display. It is noted that the resolution of the display has to be high to accommodate area modulation and derive the particular aspects and benefits of this technique.

Referring to FIG. 3, there is shown a representation of the letter E as for example, displayed on a conventional electrophoretic display. In regard to the following discussion, it will be indicated that the states of the electrophoretic display for example, as shown in FIG. 3 are black and white. Thus, in order to display the letter E as shown in FIG. 3, one requires that the pixels (pels) associated with the letter E within the particular background of FIG. 3 be black with the background being white. In any event, it is understood that the letter E will be visible if the pixels were darker than the background. As indicated above, area modulation is accomplished by writing a pattern of either black or white pels, in either the background, the foreground or both. The high resolution provided by an electrophoretic display permits the use of area modulation to generate shades of grey. Area modulation can be employed with any relatively high resolution display. Appearance of the grey scale due to area modulation is a physiological consequence of the resolution of the human eye. The effect is obtained when the angle suspended by the black and white pels as seen by the viewer, approaches the resolution of the human eye. In a typical electrophoretic display as provided by the assignee herein Copytele, a resolution of 200 lines per inch in both the horizontal and vertical directions is available. This resolution is ideal for producing grey scale by means of area modulation. On an electrophoretic display, with this resolution characters are written using a character block of 16 pixels horizontally and 24 pixels vertically. As seen in FIG. 3, both the horizontal and vertical directions are indicated by means of graduations as 30 and 31. These graduations encompass an area which is indicative of a pixel. Hence, as one can see, there is essentially 16 boxes or pixels representing the top line in the image area 32 depicted in FIG. 3. Thus, again referring to FIG. 3 it is indicated that with above noted resolution of 200 lines per inch in both the horizontal and vertical directions, character blocks consisting of 16 pixels or pels horizontally and 24 pels vertically are typical. This character block yields a display with 25 lines of 80 characters each on a display whose dimensions are approximately 6.4×3.2 inches. Thus as one can ascertain from FIG. 3, there is shown the character E which is represented in black on a relatively white background. It is of course understood that the inverse of this image could also be provided by the electrophoretic display.

Referring to FIG. 4, there is again shown the character E within the character block 32 having a 50% grey background. Essentially, the character E is the same as shown in FIG. 3 but the background consists of alternate pixels of black and white as can be seen for example, from FIG. 4. Across the top line 40, the 16 pixels are indicative of white, black, white, black and so on. On line 41, the pattern is black, white, black, white and so on. This pattern then continues to alternate down and across the display so that it alternates as to the 16 horizontal pixels and the 24 vertical pixels. The background appears grey when the image is viewed at a distance where the individual pels are unresolved. Because of this property, the number of grey shades obtainable via area modulation is again a function of the display's resolution, the size of the character and the viewing distance. As one can ascertain, the background area is modulated accordingly to produce patterns which have grey scale capability due to the nature of the modulation technique.

Referring to FIG. 5, there is shown the character block which now possesses an area modulated background which is 93.25% black. This is obtained by formulating each horizontal line within the character block, all within the display area by means of a particular Hex code. As seen in FIG. 5, line 50 is indicative of the Hex code EE where black is equal to binary one and white is equal to binary 0. Based on the display format shown in FIG. 5, in order to obtain a background which is 93.25% black, one modulates the display lines as follows. The first line 50 as seen is BBBWBBBWBBBWBBBW (Hex EE). The next three lines 51, 52 and 53 are all black or all B (Hex FF). The fourth line is BWBBBWBBBWBBBWBB (Hex BB). At the right of each line there is shown the Hex code for the line. As one can see from the Hex code notation, it is a repetitive pattern which specifies the display background as in FIG. 5 to obtain a background which is 93.25% black. The line pattern for the display of FIG. 5 is HEX, EE, FF, FF, FF, BB, FF, FF, FF and repeats for the 24 lines.

Figure 6:
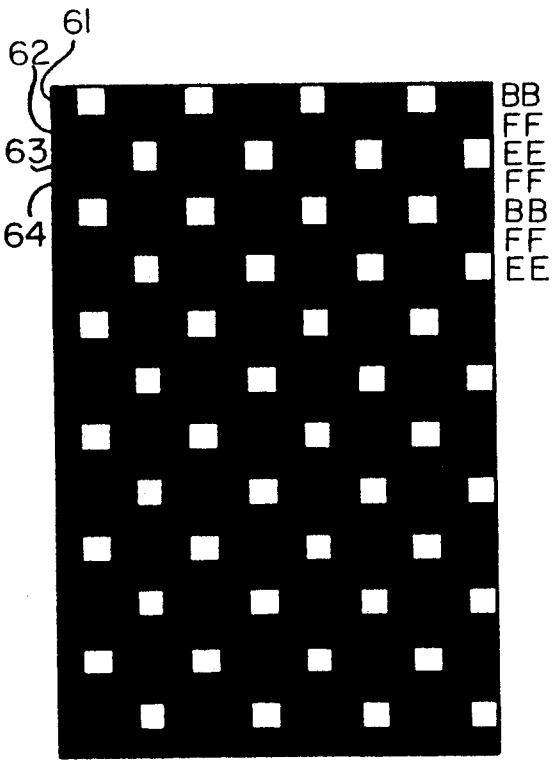
FIG. 6 is a diagram showing still another pattern.

Referring to FIG. 6, there is shown an area modulated background or character block which is 87.5% black. The Hex line values are shown at the right hand side to denote the repetitive pattern. As one can see from FIG. 6, line 61 is BWBBBWBBBWBBBWBB which is Hex code BB. Line 62 is all black which is Hex FF. Line 63 is BBBWBBBWBBBWBBBW which is hex code EE. Line 64 is all black as Hex code FF.

Figure 7:
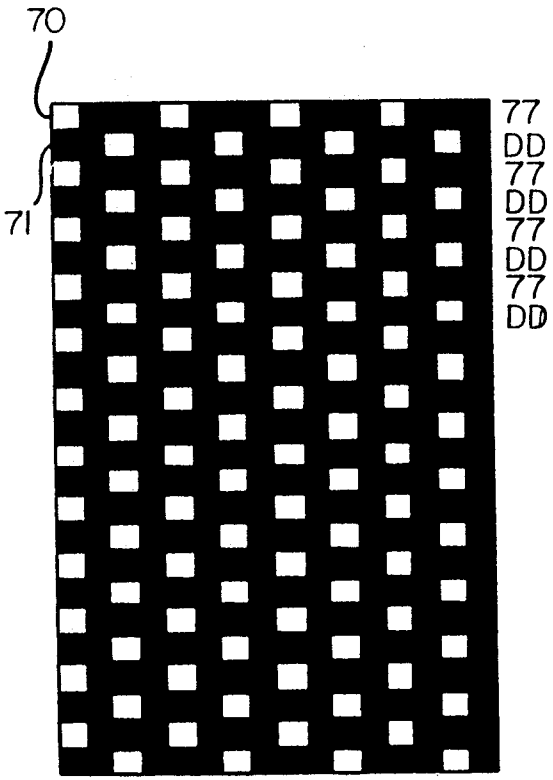
FIG. 7 is a diagram showing still another pattern.

Referring to FIG. 7, there is shown an area modulated background pattern which is 62.5% black. The Hex code is shown at the right and is a relatively simple repeating code with the first line 70 being WBBBWBBBWBBBWBBB or Hex 77. Line 71 is BBWBBBWBBBWBBBWB which is Hex DD and then the pattern repeats as Hex 77, DD, 77, DD, 77, DD . . . etc.

Figure 8:
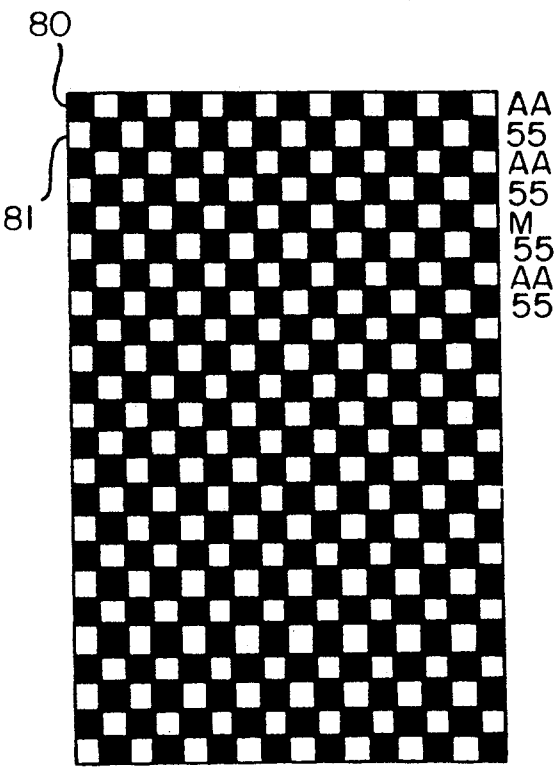
FIG. 8 is a diagram showing an alternate pattern.

Referring to FIG. 8, there is shown a pattern which is 50% black and has a simple repeat as line 80 is BWBWBWBW . . . etc. Line 81 is WBWBWB etc. which respectively denotes the hex code of AA and 55, which code repeats for the 24 lines.

Figures 9, 10, 11:
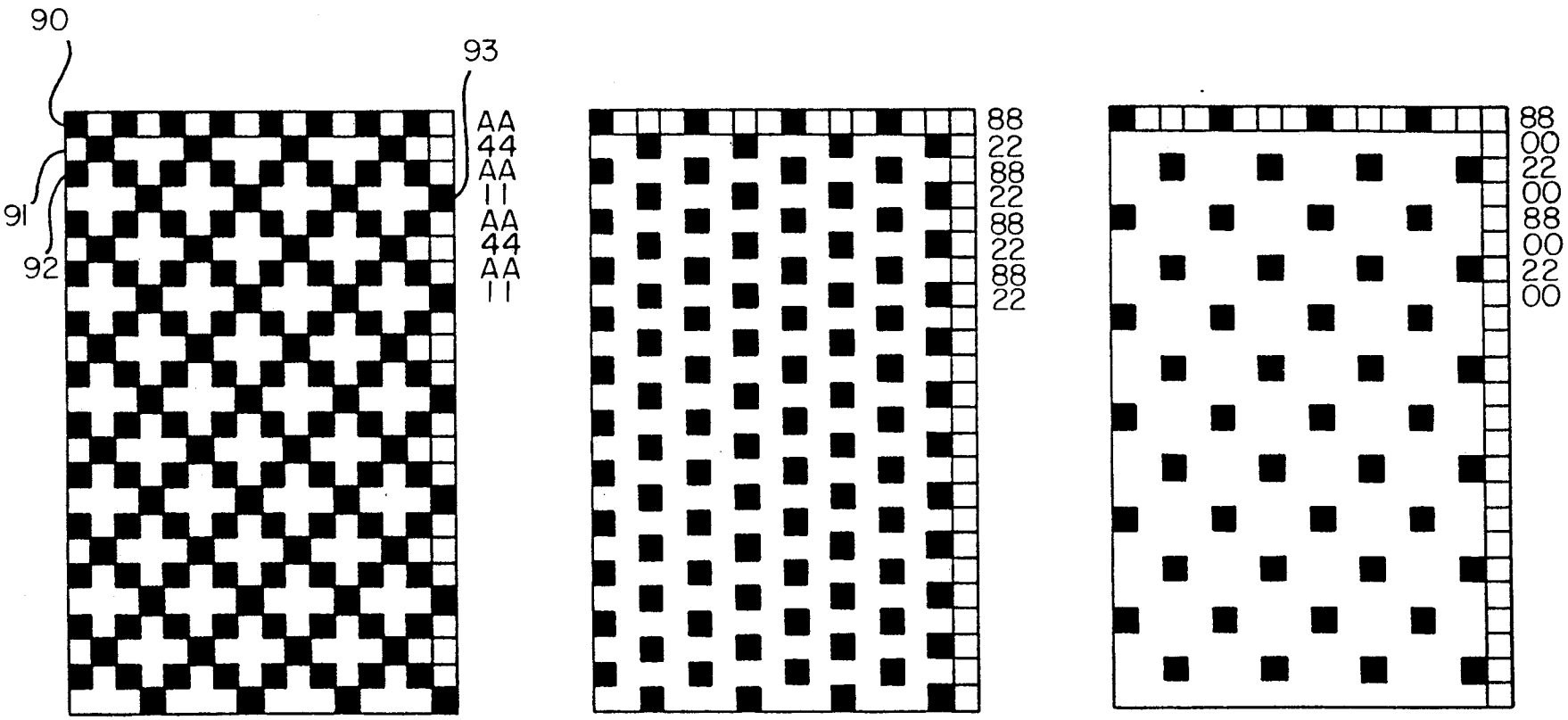
FIG. 9 is a diagram showing still another alternate pattern.
FIG. 10 is a diagram of a character block showing an alternate background pattern.
FIG. 11 is a diagram of a character block showing an alternate background pattern.

Referring to FIG. 9, there is shown an area modulated display or character block which is 37.5% black. The Hex code is shown on the right as line 90 is Hex code AA as for example, indicative of line 80 of FIG. 8, while line 91 is hex code 44 which is WBWWWBWWWBWWWBWW. Line 92 is the same as line 90 (AA) while line 93 is Hex code 11 or WWWBWWWBWWWBWWWB the code then alternates as seen in FIG. 9.

Referring to FIG. 10, it depicts a character block or display having 25% black background. The hex code is shown on the right hand side for each line.

Referring to FIG. 11, it shows a display or character block, the hex code again at the right exhibiting a 12.5% black background. As one can ascertain, the above noted figures essentially depict 6 different patterns, which 6 patterns will yield 7 different shades of grey when viewed at normal viewing distance on a 200×200 line per inch electrophoretic display. These patterns coupled with black and white yield a system with 9 shades of grey. However in practice, a background of 12.5% black can be omitted as exhibiting a small difference from white. The patterns as one can easily ascertain, which are distinct are shown in FIGS. 5–11. These figures represent various patterns which yield different shades of grey when viewed at a normal viewing distance on a 200×200 line per inch electrophoretic display. The system as shown with a 200 line resolution including black and white can produce 8 different effective shades of grey. The patterns used to achieve area modulation in a character type or graphics type display when the graphics are formed using special characters must be a factor of the character block. For example, in a display using a character block which is 16 pixels wide and 24 pixels high, the width of the area modulated pattern must be a factor (divisor) of 24 and the height of the pattern must be a factor (divisor) of 16. The figures shown in the above noted application as indicated for example in FIG. 3, are patterns which are designed for a 16×24 pel character block. The Figures show patterns which have increasingly more white (less grey), however, the actual grey shade that the human eye perceives is dependent upon many factors including display type, ambient lighting, color and other factors. It may be necessary to have unequal increments in the percentages of black and white in successive patterns to generate scales which are subjectively more and more grey. There are many techniques as one can imagine for accommodating area modulation which can be implemented simply by using registers and appropriate gating modules. Displays using shades of grey require that an attribute which describes the image foreground and background colors be designed for each character. The attribute length depends on the total number of different color combinations required. For example, if only one intermediate shade of grey is required between black and white then there are only 6 combinations of foreground/background colors. These 6 states are most readily encoded using 4 bits. Bit 0 and 1 specify the foreground color while bits 2 and 3 define the background color. In typical display systems, a byte is devoted to the attribute even though not all 64 states definable by 8 bits are used. The implementation of such a system can be done in a variety of ways. Simple implementation for generating a grey background is to OR the pel data and the selected AM pattern (Black=binary 1 and White=binary 0). This can be done in real time as the pel data and the character data is loaded into shift registers or into the drive circuitry. In systems which use a pixel memory it can be done as the pel data is generated or is loaded into the pixel memory. To make the characters or graphics a shade of grey, the procedures described can be used except that the "OR" function is replaced with an "AND" function. In inverse video, the function used to obtain a grey background is the AND function between the pixel data and the amplitude modulated pattern. To make the characters grey in inverse video, one would employ the OR function.

Figure 12:
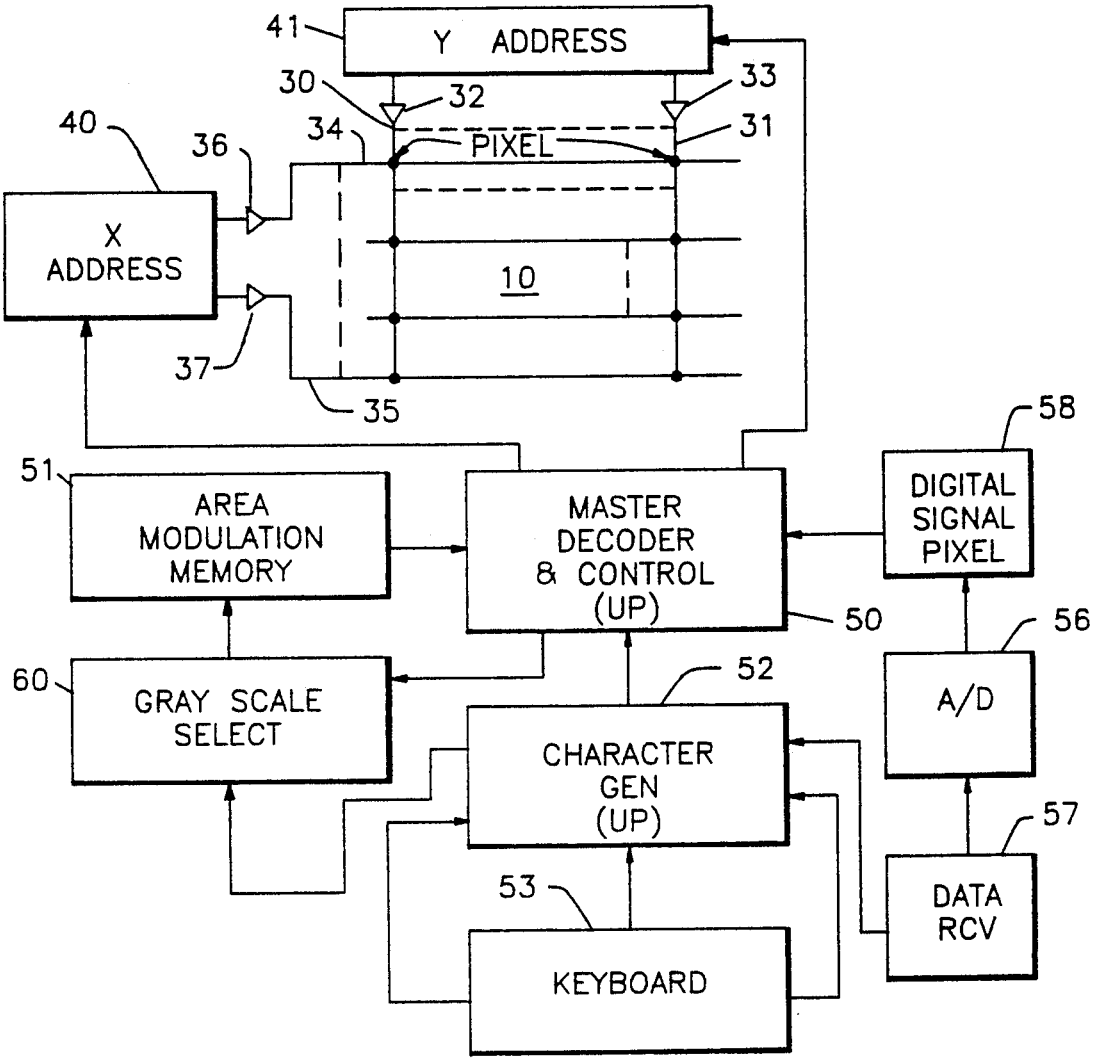
FIG. 12 is a schematic diagram partially in block form showing a circuit for deriving a grey scale value for an electrophoretic display employing area modulation.

Referring to FIG. 12, there is shown a circuit configuration in block form for an electrophoretic display panel 10 which is associated with area modulation as described above. Of course, it is understood that the cathodes and grids while described previously in the XY planes can be reversed whereby the cathode lines can be arranged in the Y plane with the grid lines in the X plane or vice versa. As one can see from FIG. 12, each Y line such as 30 and 31 is associated with suitable drive amplifiers 32 and 33, where each X line such as line 34 and 35 are associated with suitable amplifiers 36 and 37. It is of course seen in FIG. 12, that the dots or dashes between amplifiers 36 and 37 and 32 and 33 are employed to indicate a plurality of additional individual amplifiers indicative of a large number of lines. In this manner, by applying proper biasing potentials to respective amplifiers, one can cause pigment particles to migrate at any intersection between the X and Y matrix as formed by the associated grid and cathode lines. Thus, based on the X and Y matrix one can therefore produce any alphanumeric character. For such displays with a large plurality of intersections or pixels, one can provide graphic data such as a television picture and types of other displays on the display panel 10. The display which is the electrophoretic display is provided with high resolution based on the technique of fabricating line patterns and based on presently available display techniques. The driver amplifiers 32 and 33 and 36 and 37 are fabricated by typical integrated circuit techniques and may for example be CMOS devices, which are well known and many of which are available as conventional integrated circuits. As indicated, the resolution of the electrophoretic display panel is high based on modern integrated circuit techniques and including the fabrication techniques employed in conjunction with such displays. It is anticipated that the resolution of such displays can be as high as 40,000 dots per square inch. As seen from FIG. 12, the Y amplifier such as 32 and 33 are coupled to a Y address register 41. The address register 41 is a well known component consisting of various conventional decoding devices including buffer registers and so on for the storage of data and interfacing with the various columns associated with display 10. In a similar manner the amplifiers 36 and 37 have inputs coupled to an address module 40 which is similar to module 41 and operates to provide the Hex address information for the XY intersections provided by the display. Means for addressing an XY matrix is solved by many typical circuit solutions in the prior art and such decoders as the Y address register 41 and the X address register 40 are well known components in the prior art. Both the X and Y address register are coupled to a master decode module 50 which operates to decode data and to generate the X and Y addresses for such data as it conventionally known. Coupled to the decode module 50 which again may be a typical microprocessor or another programmed device is an area modulation memory 51. The area modulation memory 51 contains in storage suitable digital patterns, such as for example the hex codes as shown in FIGS. 4–11 which will enable one to produce a display according to a desired grey background. The stored data as indicated is associated with 4 bits which determine the darkness or content of both the background and foreground depending upon whether one wants to introduce the grey in the foreground or to introduce the grey in the background. The area modulation memory contains the patterns as shown in the above-noted figures to enable one to provide 6 or more levels of grey associated with a particular display and according to the preference of the user. It is of course indicated that each line of the display can be modulated by means of the code contained in memory 51 to thereby produce a uniform grey or other background for the entire display. In a similar manner, one can also modulate each character block in a different manner or modulate each line in a different manner or a portion of the display to produce various grey formats throughout the display. This can enable one to highlight certain regions of the display or certain areas of the displayed text with respect to other areas and according to the intensity of the foreground or background. The decode module 50 is also coupled to a character generator 52 which character generator is a conventional component. The character generator 52 is coupled to a keyboard 53. The character generator 52, the decoder 50 and the keyboard 53 may be part of a conventional computer system such as a PC system. There is another path shown in FIG. 12, whereby there is a data receiver 57 which is capable of receiving data from a typical telephone line or other transmission medium. This data receiver may be a conventional modem. The output of the data receiver is coupled to an analog to digital converter 56 for transforming the analog signals at the input to digital signals at the output of the analog to digital converter 56. The analog to digital converter 56 is associated with a digital signal pixel generator 58 which operates in conjunction with the master decoder 50 to allow one to perform area modulation at various pixel sites as desired. The output of the decoder 50 is also coupled to the X address register and the Y address register 40 and 41. The area modulation memory 51 is shown coupled to the decoder 50 but, can of course can be part of the microprocessor memory where a certain section will be reserved for the different area modulation background codes. As shown in FIG. 12, the module designated as grey scale select 60 is coupled to the area modulation memory 51. The module 60 decodes the particular grey scale request which data may be forwarded to the module 60 by means of the character generator 52 or by means of the decoder 50. In this manner, the system by decoding the transmitted data would automatically determine what grey scale is to be utilized for a particular display. This can be automatically done by means of suitable decoders or can be implemented at the preference of the user. As shown in FIG. 12, the character generator 52 is also coupled to the grey scale select module 60 and a user while viewing an image can go ahead and select the grey scale value desired and according to the preference of the user. As one can immediately ascertain from FIG. 12, area modulation can be simply implemented. One technique of implementing the area modulation is that the decoder or microprocessor 50 combines the area modulation code as stored in the area modulation memory with the data code. For example, if black is equal to 1 and white is equal to 0 then an "AND" or "OR" function can be used. In the OR function, whenever a pixel does not contain data, the pixel would receive the exact binary digit indicative of the background code. Where a pixel does contain data, the output will be a one if the data is a one. If the data is 0 and the background is a 1, the output would also be a 1 according to the area modulation pattern as stored. Thus the OR function provides a full black or dark character with the selected grey background as stored in the area modulation memory 51. Thus the patterns depicted in the above noted FIGS. 5 to 11 can be combined with the data pattern, to provide AND and OR functions or both as will be further explained. To present the characters or graphics with a desired shade of grey, the procedures described above can be used except the OR is replaced with an AND function. In this manner, both the data and the area modulation bit must be the same in order to produce a black spot at the output, if they are not the same then the color of the pixel remains white. As one can see, one will produce a character having a different grey scale which is presented on an all white or in the case of a negative application on an all black background. In an inverse video mode the function used to obtain a grey background is the AND function occurring between the pixel data and the stored area modulation pattern. To make the characters grey in an inverse video mode, one would employ the OR function between a grey background pattern and pixel data pattern. As indicated above and briefly described, either the characters (foreground) or the background of a display can have grey scale. Both these options and the no grey scale option can be readily generated by means of simple combinatorial circuits.

Figure 13:
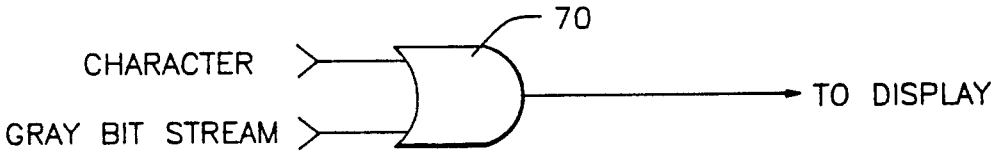
FIG. 13 shows an OR gate employed in this

Referring to FIG. 13 obviously, no grey scale requires no gating. The grey background is accomplished by OR gating the character data bit stream with the grey scale pattern bit stream as shown in FIG. 13. Thus, as indicated in FIG. 13 there is shown an OR gate 70 with one input designated as CHAR representative of the character bit stream and the other input designated as the grey bit stream. As one can ascertain, the grey bit stream would be that stream or data which has been defined in conjunction with FIGS. 5-11.

Figure 14:
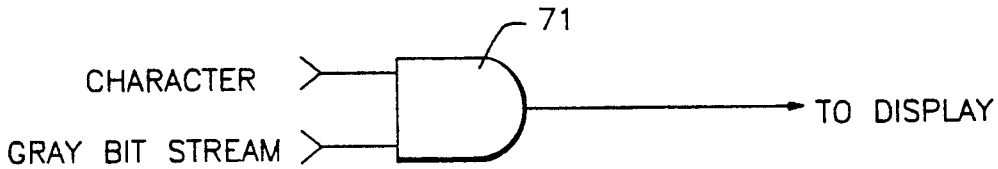
FIG. 14 shows AND gate employed in this invention.

Referring to FIG. 14 there is shown an AND gate 71 having one input designated as by CHAR and indicative of the character bit stream and the other input receiving the grey bit stream as again shown in the above noted figures. The output of the AND gate 71 is directed to the display or to the display drivers as is the output of gate 70. The grey characters are generated by the AND gate 71 which will produce grey character on a constant background. Typically, the color of each character can be described by a number of additional bits which are designated as attribute bits or an attribute byte. This set of bits or byte are normally required for each character to be displayed. The number of bytes of attribute data could be reduced by means of many different schemes which are not pertinent to this aspect of the invention. For example, an attribute byte with the following bit interpretations can be employed for generating grey scale displays.

00000000: no grey scale (black characters on white)
00000001: grey background with black characters
00000010: grey characters with white background It is noted that in the above examples only 2 bits as for example, the first and second bits are needed to generate the grey display. The other bits typically are used to specify the shade of grey desired. For simplicity, assume the desired grey shade has been selected and will be used when grey is required. With these assumptions and the example attribute code specified above, only a simple logic circuit is required to generate the required bit stream.

Figure 15:
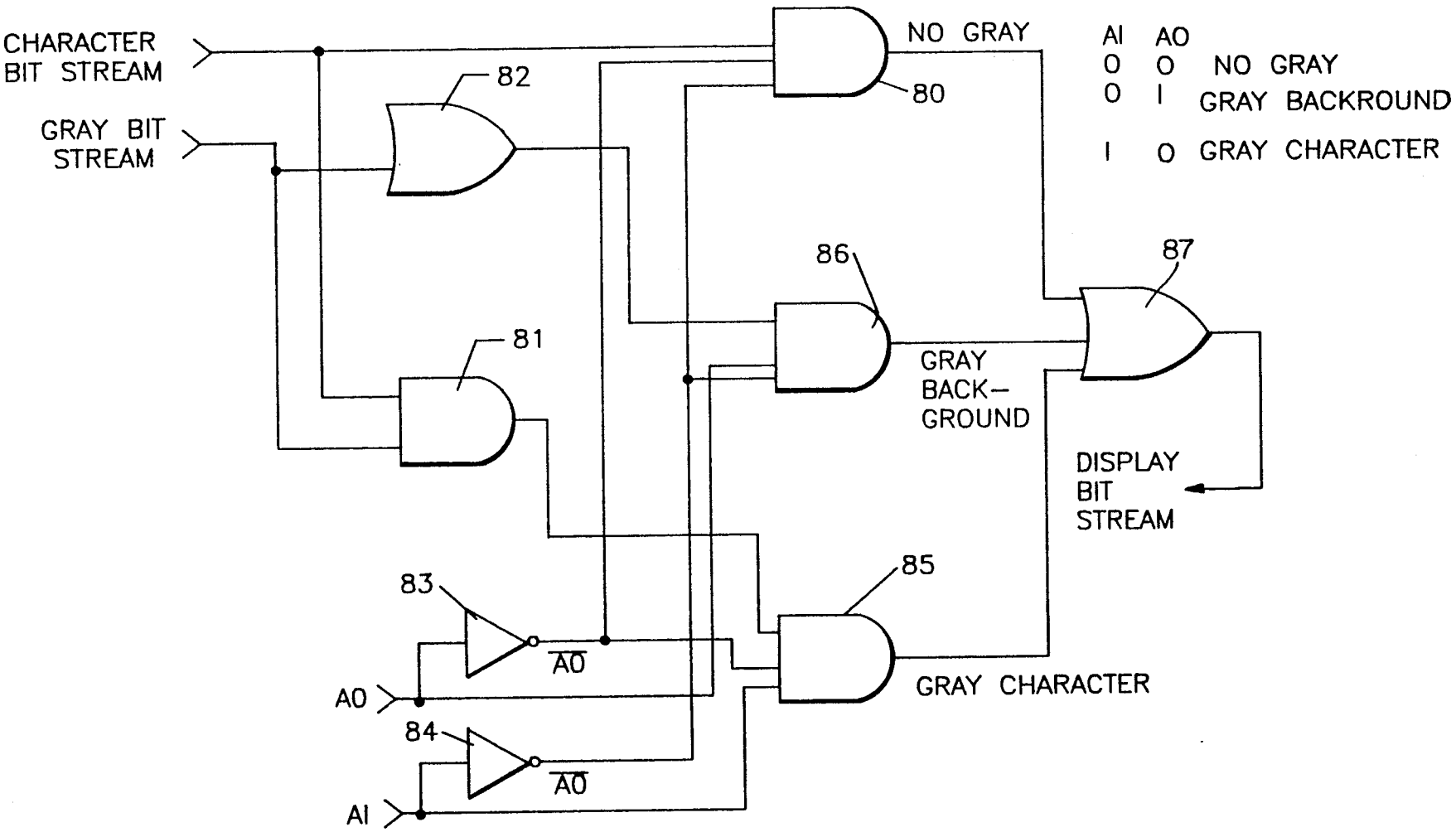
FIG. 15 shows a logic circuit for providing grey background or characters.

Referring to FIG. 15 there is shown a logic circuit capable of generating an output signal for the display which provides a grey background or a grey character as controlled by the attribute bits. As seen in FIG. 15, the attribute bits designated as A0 and A1 define the type of display. For example, 00 is no grey, 01 is a grey background and 10 is a grey character. As one can see, the character bit stream is directed to a 3 input AND gate 80 and is also directed to a 2 input AND gate 81. The grey bit stream is directed to one input of an OR gate 82 and to one input of the AND gate 81. In this manner, as one can ascertain, the attribute bits which are A0 and A1 are applied to inverters 83 and 84. The output of inverter 83 is directed to one input of AND gate 80 and one input of AND gate 85. The output of inverter 84 is applied to one input of AND gate 80 and to one input of AND gate 86. The output of OR gate 82 is coupled to one input of AND gate 86 while the output of AND gate 81 is coupled to one input of AND gate 85. As seen, the AND gates 85 and 86 also receive the attribute bits which are the uninverted bits. The outputs of the three AND gates 85, 86 and 80 are coupled to 3 inputs of an output OR gate 87, which supplies the output display bit stream. For the combination of attribute bits, the bit streams are suitably directed through appropriate gates to provide a grey background with a black character, to provide no grey, or to provide a grey character on a light background. The logic implemented by the circuit should be well understood by those skilled in the art.

Figure 16:
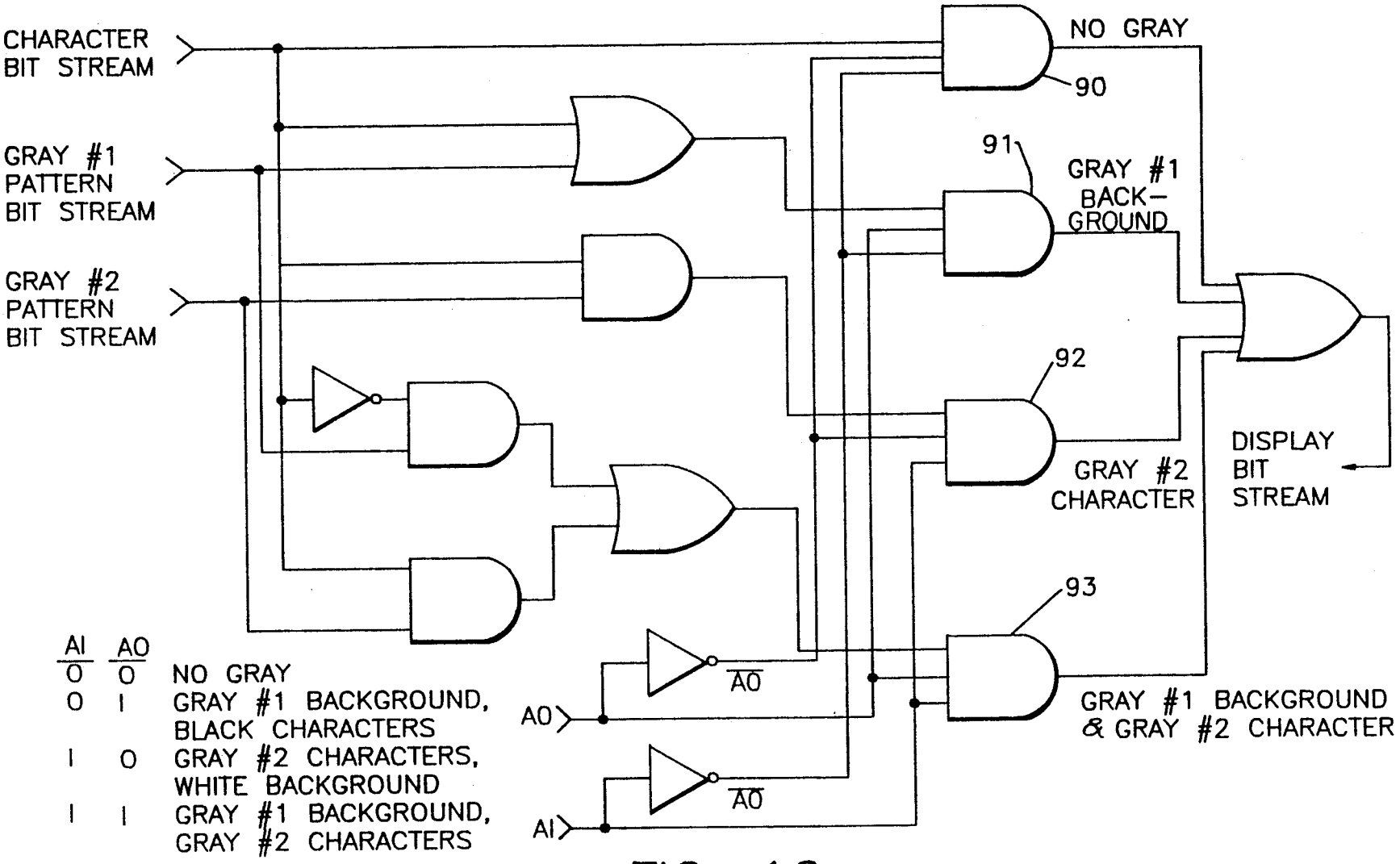
FIG. 16 shows a logic circuit for providing the character and background features.

Referring to FIG. 16, there is shown a logic arrangement which based on the attribute bit table shown, will produce either no grey, a grey background, a grey character, grey background of a given intensity or a grey background of another intensity specified as grey No. 2. Thus as seen in the FIG. 16, the attribute bits A1 and A0 can combine to produce no grey, a grey 1 background with black characters, grey #2 with a white background, grey #1 background with grey #2 characters. Thus the logic circuit shown in FIG. 16 defines a simplified logic circuit which is predicated on using either a grey pattern of a first intensity for the background and another grey pattern of a different intensity for the foreground and so on. These are indicated as a grey #1 pattern and a grey #2 pattern. Both these patterns are typical of those patterns, for example, shown in FIGS. 5–11 as described above. Again the character bit stream is inserted into the circuit with the attribute bits A0 and A1 having the binary characteristics depicted in the table of FIG. 16.

In a similar manner the circuit of FIG. 16 has 4 output AND gates designated as 90, 91, 92 and 93 with gate 90 being a no grey gate, gate 91 producing the grey 1 output as a background, gate 92 producing the grey 2 character and gate 93 enabling one to provide a grey 1 background and a grey 2 character. A description of each of the individual gates has not been given in any great detail except that the attribute bits A0 and A1 are again directed to certain gates in the uninverted state as for example, gate 93 receives the A1 uninverted as does gate 92, while gates 91 and 90 receive the A1 inverted signal. One can immediately ascertain the operation of the above described circuit by referring to FIG. 16.

We claim:

1. Apparatus for providing grey scale capability for an electrophoretic display (EPID), wherein said electrophoretic display is an X-Y addressable display with each X-Y coordinate indicative of a given column and row intersection, with each X-Y coordinate defining a pixel, which pixel when energized provides a different intensity display as compared to a non-energized pixel comprising:

means coupled to said display for impressing upon said display of plurality of predetermined digital patterns that are independent of data or an image written on said display to cause said pixels in said display to be energized with respect to other pixels in said display according to a selected one of such patterns, said energized pixels being of same intensity as those pixels of an image on said display and each of said predetermined digital patterns being distinct and arranged in repetitive configurations that produce different grey scale levels, whereby the area about said image is effectively modulated according to said pattern to vary the contrast of said image with respect to the display background.

2. The apparatus according to claim 1 wherein said pixel when energized causes a dark intensity to be displayed as compared to a lighter intensity when not energized with said darker intensity corresponding to a black level and with said lighter intensity corresponding to a white level.

3. The apparatus according to claim wherein said digital pattern is impressed on said display by means of AND logic means to cause characters as written on said display to exhibit said grey scale level with respect to the background of said display.

4. The apparatus according to claim 1 wherein said digital pattern is impressed on said display by means of OR logic means to cause said background to exhibit said grey scale level with respect to characters on said display.

5. The apparatus according to claim 1 wherein said means further includes logic means operative to cause both characters written into said display and said background of said display to be energized according to said digital pattern and in accordance with said desired grey scale level.

6. The apparatus according to claim 1, further including memory means for storing therein a plurality of digital pattern each one indicative of a different desired grey scale level, and means coupled to said memory means for selecting any desired one of said stored digital patterns for application to said display.

7. The apparatus according to claim 6 wherein said electrophoretic display is a high resolution display.

8. A method of providing grey scale capability for an electrophotographic information display (EPID) of the type employing pixel selection, comprising the steps of:

storing a plurality of digital patterns with each said digital pattern being distinct and arranged in repetitive configurations that produce different grey scale levels, said stored patterns capable when applied to an electrophotographic display to cause said pixels in said display to be energized with respect to other pixels in said display in accordance with a desired grey scale level and with each said energized pixel being of same intensity as those pixels of an image on said display, and selecting a stored pattern for application to said display be means independent of data or an image written on said display to cause said display to exhibit said grey scale level, whereby the area about said image is effectively modulated according to said pattern to vary the contrast of said image with respect to the display background.

9. The method according to claim 8 wherein said energized pixels are background pixels to provide a grey background with respect to a different intensity character.

10. The method according to claim 8 wherein said energized pixels are character pixels to provide a grey character with respect to a different intensity background.

11. The method according to Clam 10 wherein said different intensity background is indicative of white.

12. The method according to claim 10 wherein said stored digital patterns are at least six patterns indicative of six different grey scale levels.

13. The method according to claim 10 further including the step of "OR" ing said selected pattern with a character pattern prior to applying said character pattern to said display to display a given intensity character on a background of said selected grey scale level.

14. The method according to claim 10 further including the step of "AND" ing said selected pattern with a character pattern prior to applying said character pattern to said display to display a given intensity background having a character impressed thereon of said selected grey scale level.

* * * * *

UNITED STATES PATENT AND TRADEMARK OFFICE

CERTIFICATE OF CORRECTION

PATENT NO. :5,254,981

DATED :October 19, 1993

INVENTOR(S) :Frank J. DiSanto, Et al.

It is certified that error appears in the above-identified patent and that said Letters Patent is hereby corrected as shown below:

In Claim 8, Column 12, Line 25 and Line 31, delete "electrophotographic" and insert --electrophoretic--.

Signed and Sealed this

Twenty-second Day of March, 1994

*Attest:*

Bruce Lehman

BRUCE LEHMAN

*Attesting Officer*

*Commissioner of Patents and Trademarks*